United States Patent [19]

Bond

[11] Patent Number: 4,843,926

[45] Date of Patent: Jul. 4, 1989

[54] ADJUSTABLE WRENCHES

[76] Inventor: Guy R. Bond, 768 Peach Tree Ln., Erlanger, Ky. 41018

[21] Appl. No.: 165,259

[22] Filed: Mar. 7, 1988

[51] Int. Cl.[4] ..... B25B 13/58

[52] U.S. Cl. ..... 81/185; 81/128

[58] Field of Search ..... 81/128, 90.2, 185, 185.2, 81/186, DIG. 11

[56] References Cited

U.S. PATENT DOCUMENTS 1,204,383 11/1916 Spanier ..... 81/90.2

*Primary Examiner*—Frederick R. Schmidt
*Assistant Examiner*—Lawrence Cruz
*Attorney, Agent, or Firm*—Kinney & Schenk

[57] ABSTRACT

An open end wrench and a socket wrench are described which are selectively adjustable to rotate fasterners dimensioned pursuant to the English system or the metric system. Both wrenches compris first and second elements having parallel surfaces spaced apart to engage flats, of a given width, on a fastener. Parallel linkage means control relative movement of the two elements between first and second positions. In the first position, the linkage is parallel to the flat engaging surfaces and the flat engaging surfaces thereof are spaced for rotation of a fastener having flats of the given width. In the second relative position of the elements, the linkage means is generally normal to the flat engaging surfaces and the flat engaging surfaces thereof are offset, with one surface of the first element being laterally spaced from one surface of the second element a predetermined lesser distance for rotation thereby of a fastener having flats of a width approximately said lesser distance.

6 Claims, 2 Drawing Sheets

ADJUSTABLE WRENCHES

The present invention relates to wrenches and more particularly to improvements in adjustable wrenches.

Wrenches are a well known class of tools for rotating or applying torque to rotatable members, primarily threaded fasteners, such as nuts, bolts and screws. Rotation is effected through flats on opposite sides of the axis of the fastener. (While wrenches may be employed in the rotation of any rotatable member, for the sake of simplicity, reference herein will be made to fasteners.)

In the class of fasteners of interest the fasteners have square or hexagonal cross sections, thus providing two or three pairs of flats which may be engaged by the wrench in effecting rotation. The width across such flats defines the size of wrench required.

There are two primary types of wrenches used in rotating fasteners having these cross sections, namely open end wrenches and socket wrenches, box wrenches being considered a variation of the socket wrench. These wrenches are available in sets to span various ranges of fastener sizes, or, more particularly, the range of widths across flats.

Until recently, in the United States, practically all threaded fasteners were dimensioned in inches, pursuant to the English system. Thus, one common range of wrench sizes is 1/4 inch to 1 inches, with wrenches being provided for each even sixteenth increment of an inch. An experienced worker can visually identify the size of a nut or bolt and automatically select the appropriate size wrench. This ability greatly facilitates repair work, where the use of different size fasteners is to be expected. resulting from domestic manufacture, there is an increasing use of fasteners dimensioned pursuant to the metric system. In the referenced range of $\frac{1}{4}$ inch to 1 inch, the width across fastener flats is, generally, in even millimeters in one or two millimeter increments. These fasteners are, of course, intended to be rotated by wrenches sized in accordance with the metric system.

The difference between the standard English sizes, i.e., even sixteens and the nearest even millimeter size, is sufficient that the English system wrenches are not, for the most part, effective in rotating metric fasteners, particularly where a significant amount of torque is required.

To deal with the two measurement systems, it has become a common practice to have at hand two separate sets of wrenches, which has an obvious cost disadvantage.

More importantly, repair work, for example, becomes more time consuming. While visually identifying sixteenth inch increments can be readily done, it is extremely difficult to distinguish between metric and English sized fastener sizes. Thus the facility of automatic wrench selection is no longer available and wrench selection becomes a trial and error process.

Obviously the use of wrenches having adjustable gripping surfaces would obviate the need of two sets of wrenches. However, in most of the many proposals for adjustable wrenches, more time would be lost in effecting the necessary adjustment than would be required in selecting the proper wrench from two sets.

A further shortcoming of the many prior art, adjustable wrenches, is a lack of rigidity in accurately spacing the surfaces which engage the flats of the fastener. This makes them ineffective in rotating a fastener, where a significant torque force is required.

Accordingly, the object of the present invention is to facilitate the rotation of fasteners manufactured pursuant to either the English or metric system.

Another object of the present invention is to provide an adjustable wrench, suitable for such purposes, which may be readily switched between English and metric system positions.

A further object of the invention is to provide an adjustable wrench which has a strength and rigidity approaching that of a single size, integral wrench.

Yet another object of the invention is to provided both open end socket wrenches suitable for the above ends.

These ends may be attained by a wrench for rotating a fastener having torquing flats. The wrench has the capability of gripping flats having a first width or a second, lesser width.

The wrench has first and second elements. Each element has a pair of opposed, parallel engaging surfaces spaced a distance approximating the first flat width.

A parallel linkage controls relative movement of the first and second elements between first and second relative positions.

In the first position, the parallel linkage is generally parallel with the parallel engaging surfaces and the engaging surfaces of the first element are aligned with the engaging surfaces of the second element.

In the second position, the parallel linkage is generally normal to the engaging surfaces and the engaging surfaces of the upper element are parallel to and offset from the engaging surfaces of the lower element. The fastener flats of said lesser width may be engaged by one surface of the upper element and one oppositely facing surface of the lower element in rotating the fastener.

Preferably the parallel linkage mechanism comprises a plurality of pins. Each pin has upper and lower portions offset on parallel axes. The upper portions of the pins are pivotally mounted in the first element and the lower portions are pivotally mounted in the second element.

The first and second elements may be of a C-shaped configuration to provide an open end wrench. A handle extends outwardly from the closed end of one of these elements to enable manual application of torque in rotating a fastener.

Alternatively, the second element may have a hexagonal recess defined by the flat engaging surfaces thereof, plus two additional pairs of flat engaging surfaces. The first element may have a central passageway defined in part by the flat engaging surfaces thereof. The first element passageway may also be defined bya third surface which is parallel with the surfaces of one of the other pairs of surfaces on the second element. This third surface, in the second relative position of the elements, is laterally spaced from one of the surfaces with which it is parallel, a distance also approximating said lesser flat width, when adjusted for rotation of a smaller fastener.

The above and other related objects and features of the invention will be apparent from a reading of the following description of preferred embodiments of the invention, with reference to the accompanying drawings, and the novelty thereof pointed out in the appended claims.

Figure 1:
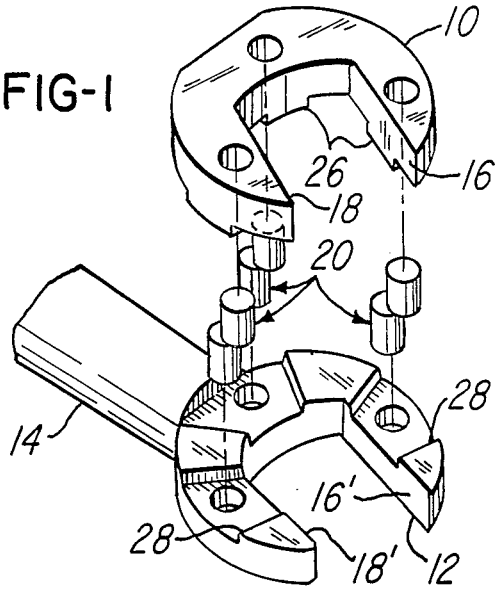
FIG. 1 is an exploded, perspective view of an open end wrench embodying the present invention.

Wrenches, as noted above, are a basic tool for the rotation of threaded fasteners, They take several forms. Attention herein is first directed to open end wrenches. Rotation of a a large class of fasteners is effected through opposite surfaces of a square or hexagonal cross section. Both nuts and the heads of screws and bolts are provided with such cross sections for torqueing purposes. Opposite sides of the cross sections provide parallel flats which are engaged by a wrench in rotating the fastener. The width of the flats, i.e., the distance therebetween needs to be approximated by the distance between the surfaces of the wrench which engage them in rotating the fastener.

An open end wrench embodying the present invention is illustratd in FIGS. 1–6. It comprises an upper C-shaped element 10 and a lower C-shaped element 12. A handle 14 is formed integrally with and extends from the closed end of the C-shaped element 12.

The C-shaped element 10 has opposed, parallel surfaces 16, 18 and the C-shaped element 12 has opposed, parallel surfaces 16', 18', The distance between the surfaces 16, 18 and the distance between the surfaces 16', 18' approximates and is slightly larger than an even sixteenth of an inch. For illustrative purposes, the nominal distance could be set at 9/16 inch.

The C-shaped elements, 10 and 12, are interconnected by three pins 20 which control relative movement therebetween. Each pin 20 comprises an upper portion 22 and a lower portion 24. The upper and lower portions are formed cylindrically about offset axes a and b. The upper portions 22 are pivotally in the upper element 10 and the lower pin portions are pivotally mounted in the lower C-shaped element 12. The elements 10 and 12 may be provided with matching projections 26 and grooves 28 in their mating surfaces.

It will be appreciated that the upper and lower portions of the pins 20 may be integrally formed by reason of the fact that the offset between the axes a and b is substantially less than their diameters. For purposes of structural strength it is preferred that the offset be no more than about 30% of the diameters of the upper and lower portions. The offset is exaggerated in the drawings.

In assembling the exploded relationship of the components illustrated in FIG. 1, the upper and lower pin portions 22, 24 have lengths greater than the thickness of the C-shaped elements 10, 12 and project beyond the outer surfaces thereof. These projecting portions may then be swaged to form the heads (FIG. 5) which hold the components in assembled relation.

The elements 10 and 12, in combination with the pins 20 form a parallel linkage. The portion of the pin material between the axes a and b functions as a link. This is further illustrated in FIG. 6 by the broken line showing of link L which represents the linkage function of the pin 20. The smaller, broken circles make more apparent the pivotal connections for the link function of the pins 20 and how they form a parallel linkage mechanism in combination with the elements 10, 12.

Figure 2:
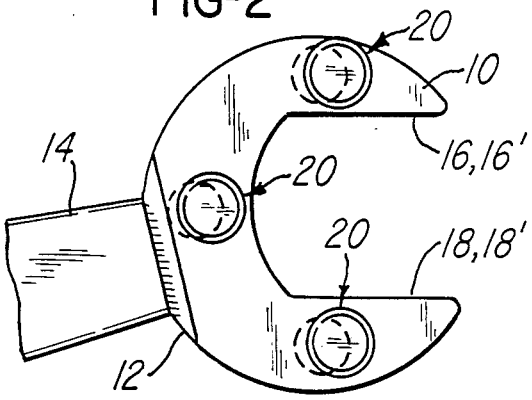
FIG. 2 is a plan view of the present open end wrench.
Figure 3:
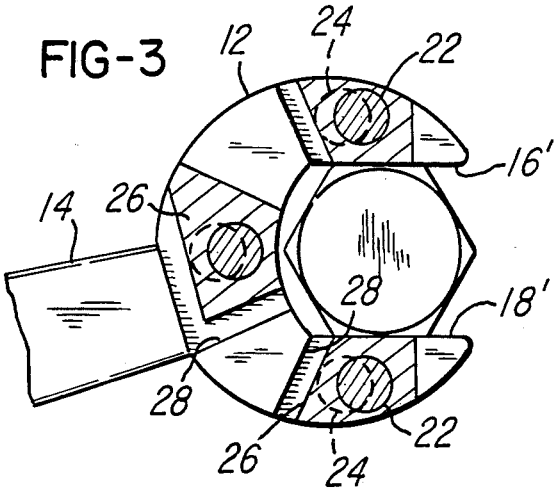
FIG. 3 is a section taken at the interface between adjustable elements of the wrench.

FIGS. 2 and 3 illustrate the wrench adjusted for the English measurement system, for use with fasteners having, as indicated above, a width across its flats of 9/16. In this relative position of the elements 10 and 12, the parallel linkage is generally parallel to the flat engaging surfaces 16, 18, 16', 18'. The engaging surfaces of the upper element 10 are aligned with the engaging surfaces of the lower element 12.

Figure 4:
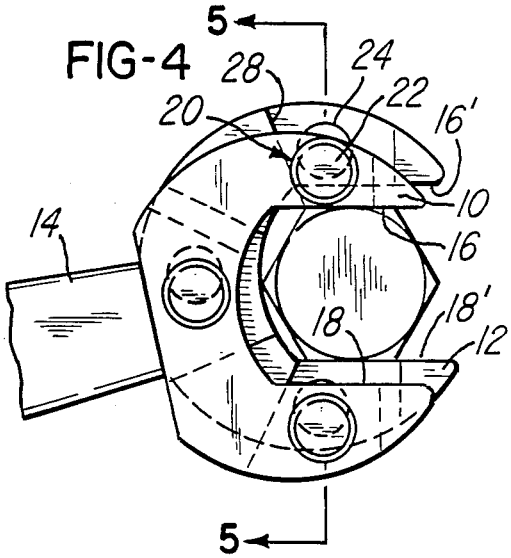
FIG. 4 is a plan view of the same wrench, adjusted for rotation of a fastener having flats of a lesser width.
Figure 5:
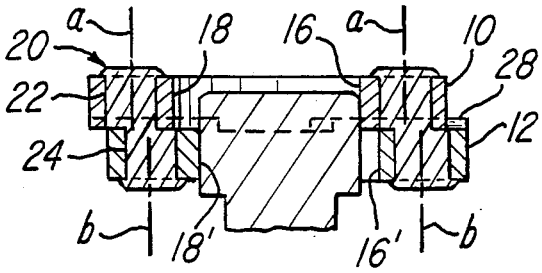
FIG. 5 is a section taken on line 5—5 in FIG. 4.
Figure 6:
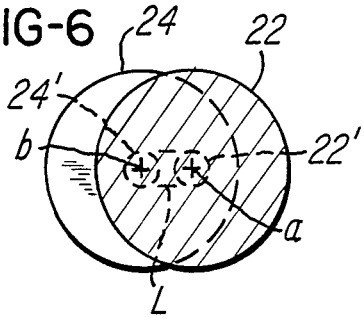
FIG. 6 is a plan view, partly in section, of one of the pins controlling adjustment of the wrench.

FIGS. 4 and 5 illustrate the wrench elements 10 and 12 in their second relative position. The selected nominal size of 9/16 inch illustrates that certain English system sizes sufficiently approximate an even millimeter size to permit their use on metric fasteners. Expressed decimally, 9/16 inch is 0.5625 inch and 14 millimeters is 0.5512 inch. The difference is only 0.0113 inches. A nominal clearance of 0.0113 between the gripping surfaces is within permissible limits for use of the 9/16 spacing on fasteners having a width across flats of 14 millimeters.

The wrench as seen in FIGS. 4 and 5 is adjusted for a flat width of 13 millimeters 0.5118 inch). The offset between the axes a and b, and the effective length of the links L is 0.0507 inch. Thus, in the second position, the linkage is generally normal to the engaging surface 16, 18 which are maintained parallel with the gripping surfaces 16', 18' and offset therefrom. In this second position, the surface 16 of the upper element 10 and the surface 18' of the lower element 12 are spaced apart 13 millimeters and become the active engaging surfaces for rotating a metric sized fastener, FIG. 5.

Figure 7:
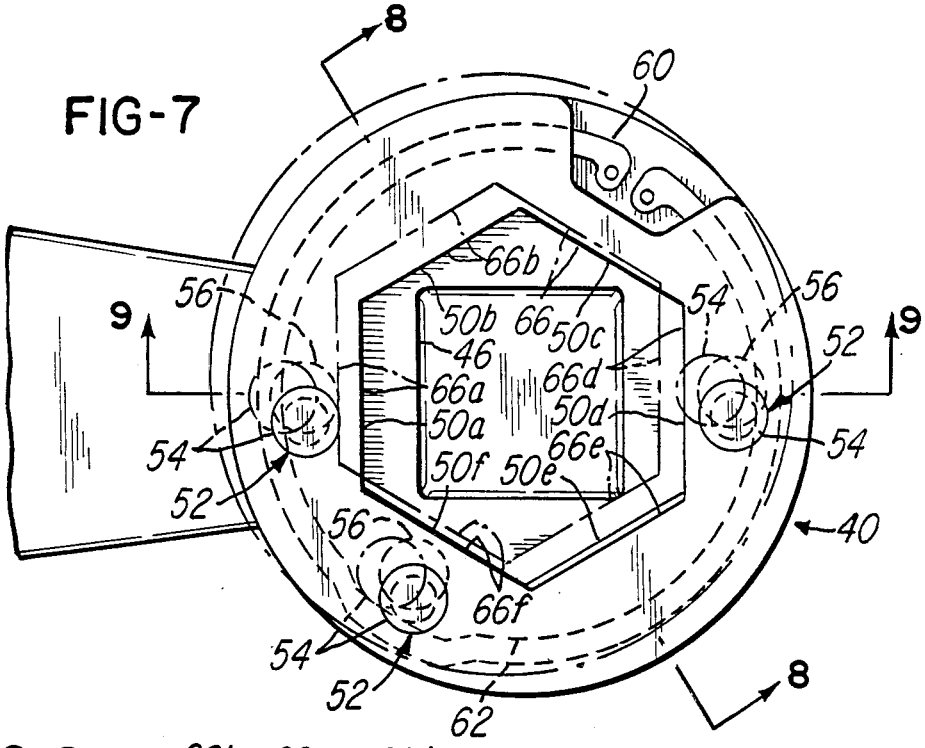
FIG. 7 is a plan view of a socket wrench embodying the present invention.
Figure 8:
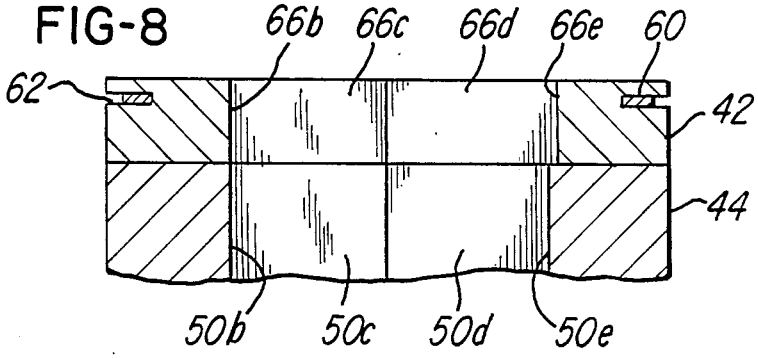
FIG. 8 is a section taken on line 8—8 in FIG. 7.
Figure 9:
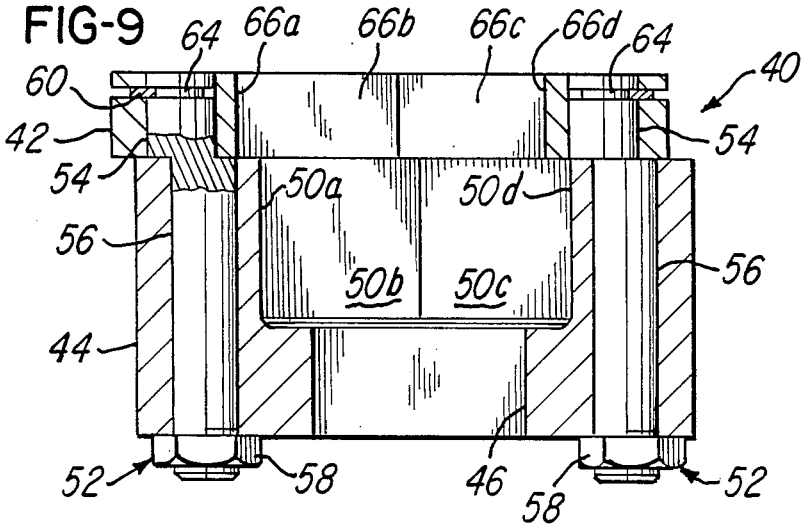
FIG. 9 is a section taken on line 9—9 in FIG. 7, with the socket adjusted for rotation of a fastener having flats of a lesser width.

Reference is next made to FIGS. 7–9 for a description of a socket wrench embodying the present invention. This type wrench is conventionally provided as a set of "sockets" having recess sized, in accordance with the English system for engagement with fasteners having flat widths in even sixteenth inch increments. The sockets are telescoped over a nut or bolt head for engagement of the walls of the recess with the flats, or corners of the flats, to rotate the fastener. It is more common to employ socket wrenches in the rotation of fasteners having hexagonally disposed flats. Accordingly, the recesses of the sockets are usually provided with a hexagonal outline, or a so called twelve point outline.

A socket 40 comprises an upper element 42 and a lower element 44. The lower element 44 is provided with a square opening 46 for detachably receiving a torque bar 48, in conventional fashion.

The lower element 44 is provided with a recess of hexagonal outline for engagement with a hexagonal nut or bolt head having a corresponding flat width. The recess is defined by walls designated 50*a*, 50*b*, 50*c*, 50*d*, 50*e* and 50*f*. This provides three pairs of parallel engaging surfaces, each spaced apart the same, even nominal sixteenth of inch incremental distance. Again this may be exemplified by a 9/16 inch size.

As with the first embodiment, the upper element 42 is manually shiftable between a first, English system position and a second metric system position. This movement is controlled by three pins 52 which provide a parallel linkage mechanism which 25 operates, in principle, in the same fashion as described in connection with the open end wrench. Thus, each pin comprises an upper portion 54 formed cylindrically about an axis which is offset from the parallel axis about which a lower cylindrical portion 56 is formed.

The lower ends of the cylindrical portions 56 are threaded to receive nuts 58. The upper portions 54 are rotatable received in the upper element 42. A detachable retaining ring 60 is received in a groove 62 formed in the element 42 and engages grooves 64 in the upper pin portions 54, to hold the elements and pins in assembled relation.

The upper element 42 has a pair of parallel, opposed engaging surfaces 66*a* and 66*d* and a second pair of opposed surfaces 66*c*, 66*f* which are spaced apart the exemplary, nominal 9/16 inch distance. In the English measurement system adjustment (illustrated in solid lines in FIG. 7), the surfaces 66*a* and 66*d* are aligned, respectively, with the lower element surfaces 50*a*, 50*d*.

The central passageway is also defined by opposed surfaces 66*b*, 66*e*. In the English system adjustment, the surface 66*b* may be aligned with the lower element surface 50*b*, with the surface 66*e* spaced outwardly from the surface 50*e*.

In the first relative position of the elements 42, 44, FIG. 7 (the English system setting), the parallel linkage comprising the pins 52 is disposed parallel to the surfaces 50*a*, 66*a*, a, as well as the paired surfaces 50*d*, 66*d*.

The elements 42, 44 are manually shiftable to the second relative position illustrated by the phantom position of FIG. 7 and in FIG. 9. In this position the parallel linkage is generally normal to the primary flat engaging surfaces 66*a* of the upper element 42 and 50*d* of the lower element 44. These surfaces become the primary flat engaging surfaces for rotation of a fastener. The offset between the axes of the upper and lower pin portions, 54, 56, is selected so that the distance between these surfaces is, nominally an even millimeter dimension (again 13 millimeter, for illustrative purposes) and suitable for rotation of a metric fastener.

It will also be seen in FIG. 7, that the surfaces 66e and 50*b* are spaced the same, even millimeter distance and may provide an additional pair of flat engaging surfaces for rotation of metric fasteners. The initial offset of the surface 66*e*, from the surface 50*e* is selected so that these surfaces will be aligned when the upper element is displaced to its metric system position.

While there are a lesser number of flat engaging surfaces effective in rotating the smaller, metric fastener, nonetheless, they are adequate and suitable for most all situations.

In the described embodiments, the English system positions provide essentially the same flat engaging forces as in conventional wrenches. There is some compromise in the metric system. This choice has been made in view of the expectation that metric fasteners will be less frequently encountered. If the situation should be otherwise, then the so-called "first" positions could be sized for metric fasteners and the "second" positions could be sized for English measurement system fasteners.

Other variations will occur to those skilled in the art within the spirit and scope of the present inventive concepts which are set forth in the following claims.

Having thus described the invention, what is claimed as novel and desired to be secured by Letters Patent of the United States is:

1. A wrench for engaging flats on a fastener to effect its rotation, said wrench being adjustable to selectively rotate fasteners with flats having a given width or flats having a given, lesser width, said wrench comprising a first element having parallel, opposed flat engaging surfaces spaced apart a distance approximating said given flat width, a second element having parallel, opposed flat engaging surfaces spaced apart a distance approximating said given flat width, and parallel linkage means controlling relative movement of said elements between first and second positions, said elements, in their first position, having their first engaging surfaces aligned by the parallel linkage being parallel to said flat engaging surfaces, said elements, in their second position, having their flat engaging surfaces offset, with the links of the parallel linkage being generally normal thereto, whereby one flat engaging surface of the upper element and an oppositely facing engaging surface of the lower element are laterally spaced a distance approximating said lesser flat width.

2. A wrench as in claim 1, wherein the parallel linkage means comprise a plurality of pins, each pin having an upper portion pivotally mounted in the first element and a lower portion pivotally mounted in the second element about an axis laterally offset from the axis of the upper portion, the lateral distance between said axes approximating the difference between said given width and said lesser given width.

3. A wrench as in claim 2, wherein the first and second elements are C-shaped and the flat engaging surfaces thereof extend inwardly from the open end of the C-shaped configurations, and the pivotal axes of two pins are disposed intermediate the lengths of the flat engaging surfaces and are respectively disposed on opposite sides thereof, and further wherein a handle extends outwardly from the closed end of one of said C-shaped elements.

4. A wrench as in claim 3 wherein the spacing between the flat engaging surfaces of the upper and lower elements is, nominally, an even sixteenth inch fraction in the range of $\frac{1}{4}$ inch to 1 inch, and the distance between the offset, pivotal axes of each pin approximates the difference between the even fractional inch spacing of the flat engaging surfaces and a smaller, even millimeter dimension.

5. A wrench as in claim 2 wherein the second element has a central recess of hexagonal outline defined by the spaced, flat engaging surfaces thereof, and two additional pairs of equally spaced, parallel flat engaging surfaces, said second element further having means for detachably receiving a torque bar.

6. A wrench as in claim 5 wherein the first and second elements have a generally circular cross section, and the first element has a central recess of hexagonal outline defined in part by the flat engaging flats thereof and two additional pairs of flat engaging surfaces, the flat engaging surfaces of one of said additional pair of surfaces being respectively aligned with the flat engaging surfaces of one of the additional pair of surfaces of the second member, in the first position of the elements, the other additional surfaces of the second element in the first position of the elements and having its other surface spaced from said one surface of the other additional pair of surfaces of the second element, a distance approximating said lesser flat width in the second position of the elements.

* * * * *